US006863508B2

(12) United States Patent
Hauser

(10) Patent No.: US 6,863,508 B2
(45) Date of Patent: Mar. 8, 2005

(54) MEASURING GAS PUMP WITH HEATED AND INSULATED PUMP HEAD

(75) Inventor: Erwin Hauser, Emmendingen (DE)

(73) Assignee: KNF Neuberger GmbH, Freiburg (DE)

( * ) Notice: Subject to any disclaimer, the term of this patent is extended or adjusted under 35 U.S.C. 154(b) by 0 days.

(21) Appl. No.: 10/258,095

(22) PCT Filed: Feb. 23, 2001

(86) PCT No.: PCT/EP01/02065

§ 371 (c)(1),
(2), (4) Date: Oct. 19, 2002

(87) PCT Pub. No.: WO01/81763

PCT Pub. Date: Nov. 1, 2001

(65) Prior Publication Data

US 2003/0077186 A1 Apr. 24, 2003

(30) Foreign Application Priority Data

Apr. 20, 2000 (DE) ..... 100 19 725

(51) Int. Cl.[7] ..... F04B 39/06

(52) U.S. Cl. ..... 417/373; 417/413.1; 417/572; 417/313; 92/187; 92/140; 92/144; 165/185

(58) Field of Search ..... 417/313, 413.1, 417/572, 373; 92/187, 140, 144; 165/185

(56) References Cited

U.S. PATENT DOCUMENTS 3,738,035 A * 6/1973 Bricker ..... 40/431
4,716,926 A 1/1988 Jacobs
4,790,730 A 12/1988 Spaeth et al.
4,932,214 A * 6/1990 Nieratscher et al. ..... 62/50.6
5,403,167 A * 4/1995 Kobayashi et al. ..... 417/461
5,407,000 A * 4/1995 Mercer et al. ..... 164/457
5,461,966 A * 10/1995 Becker et al. ..... 92/1
5,465,581 A * 11/1995 Haertl et al. ..... 62/50.1
5,564,914 A * 10/1996 Kobayashi et al. ..... 417/423.7
5,865,092 A * 2/1999 Woudwyk ..... 92/216

FOREIGN PATENT DOCUMENTS

DE 19854719 A1 * 5/2000
JP 51118104 10/1976
JP 51-118104 * 10/1976
JP 52018209 2/1977

OTHER PUBLICATIONS http://www.pacificplus.com/products.htm, Pacific Plus International, Inc., Hwa Yang Stainless Steel Group, Products, p. 1, Aug. 10, 2004.

*Guide to the Selection of The Surface Finish of Stainless Steel on Fabricated Items*, SHAPA Technical Bulletin No. 1, Jan., 2000, p. 14.

* cited by examiner

*Primary Examiner*—Denise L. Esquivel
*Assistant Examiner*—Emmanuel Sayoc
(74) *Attorney, Agent, or Firm*—Volpe and Koenig, P.C.

(57) ABSTRACT

A pump for gases to be measured having a pump housing in which a pump chamber is located. The pump chamber is sealed off by a working membrane that is connected to a crank drive by a connecting rod or similar lifting mechanism. A heating device is provided in an upper area of the pump housing, particularly in the pump head. Heat insulation covering at least the pump head is provided. The heat insulation is in the form of an insulating housing having an inner wall spaced apart from the pump head in order to form a gas insulation layer.

9 Claims, 1 Drawing Sheet

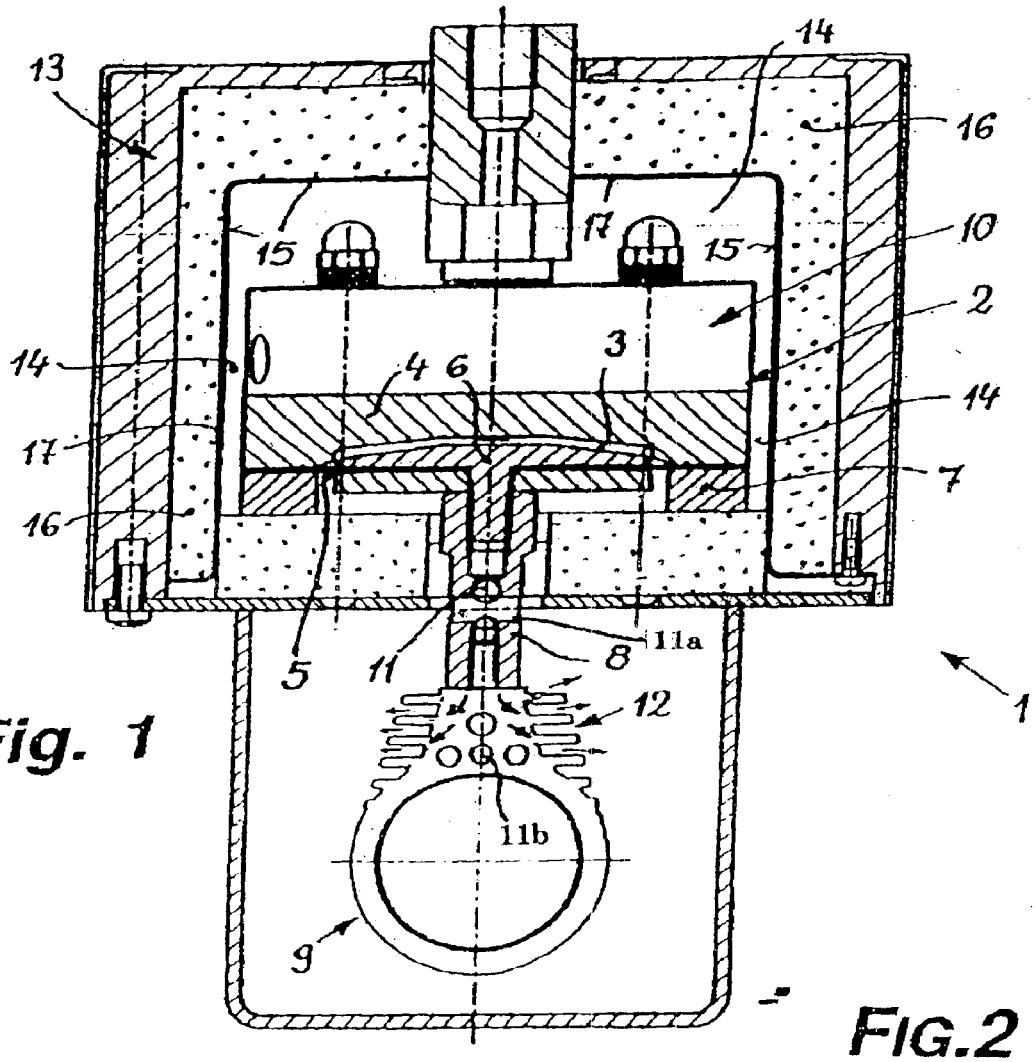
Fig. 1
FIG.2
FIG.3
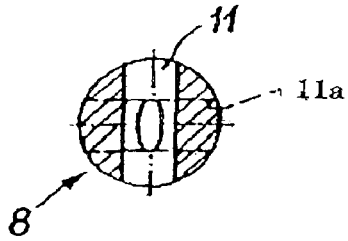
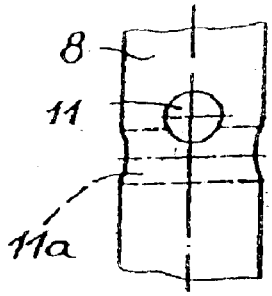

MEASURING GAS PUMP WITH HEATED AND INSULATED PUMP HEAD

The invention is directed to a pump for gases to be measured, which includes a pump housing, a pump chamber located in it that is sealed off by a working membrane, with the membrane being driven by a crank drive by means of a connecting rod or similar displacement mechanism. A heating device is provided in the upper region of the pump housing, in particular in the pump head, and heat insulation is provided that surrounds at least the pump head, which can be formed by an isolation housing having an inner spaced apart from the pump head.

Pumps of this type are used to convey hot gases to be measured whose temperature is to be maintained in the condition in which the gases are withdrawn as much as possible. The analysis gas components should be prevented from condensing, which falsifies the measurement results. For hot gas pumps of this type, in order to keep the parts that come into contact with the gas to be measured at the temperature prescribed by the point of withdrawal of the gas to be measured, a heater is provided in the pump head to keep the temperature of the gas to be measured from dropping, or at least to minimize the temperature drop, within the pump chamber.

DE 4322272 C2 specifies a heat-conducting cap, or a thermally conducting insulating cap, that surrounds the pump head.

This makes it possible to even out the temperature distribution in the area of the pump head somewhat, but a relatively high level of heat radiation, and thus of associated losses, continues to result.

A measuring gas pump is also known in which the upper part of the pump which includes the pump head is surrounded with a hood-shaped heat insulation (see DE 86 02 787). This heat insulation is in the form of an open bottom container. Between the heat insulation and the upper part of the pump is a radially extending as well as in an axially upwardly extending uninterrupted space which provides an air isolation area. In this way a large temperature radiation in the known measuring gas pump is prevented. However, a heater in the area of the upper part of the pump is not provided.

SUMMARY

The object of this invention is to further reduce the outward radiation of heat from the pump head and to improve the even temperature distribution in the area of the pump head.

To accomplish this object, it is provided that the insulating housing has a heat radiation reflecting surface. Through this heat radiation reflecting surface, the insulating properties of the heat insulation is improved and an undesired heat radiation loss is reduced.

The gas or air jacket formed between the pump head and the inside of the insulating housing forms an effective intermediate insulating layer, through which the outward radiation of heat is significantly reduced. In addition, the heat distribution in the area of the pump head is improved by this more effective insulation.

Advantageously, the inside of the insulating housing has a heat-insulating layer, preferably made of glass fiber material or similar heat-resistant material. This layer, in combination with the intermediate insulating air layer and the heat radiation reflecting surface layer, results in an especially good thermal insulation.

In a further advantageous embodiment of the invention, the inside of the insulating housing is made to reflect the heat radiation, or the thermal-insulating layer supports the reflection layer on the inside. The reflection layer can thus be provided either directly on the inside of the insulating housing or on the inside of any additional provided layer, if present.

In a preferred and advantageous embodiment of the invention, the heat radiation reflection layer is a mirror-finished reflection layer made of stainless steel.

A preferred embodiment provides that the insulating housing is constructed in a sandwich fashion and that it has a metal hood on the inside that is spaced at a distance from the pump head, preferably made of stainless steel, followed by an outwardly located heat-resistant thermal insulating layer and an outer thermal insulating layer preferably made of plastic.

This design of the insulating housing results on the one hand in good durability on the inside, even at high operating temperatures of the pump, very good insulation values and a good shape stability.

To this end, the insulating housing encloses at least the pump head all around, with penetrations being provided for at least pressure and suction feed lines as well as for the connecting rod. This forms an insulation that practically encapsulates the pump head.

Because of the heater provided in the area of the pump head, the undesirable side effect arises in that the connecting rod end at the membrane side heats up as well, and the crank drive is heated through the connecting rod, whereby in particular the connecting rod bearing can be damaged.

The very effective insulation of the pump head by means of the gas insulation layer increases the occurrence of this effect. To reduce this heat transfer from the pump head to the crank drive, there are, first of all, through holes provided in the drive transmission area between the connecting rod end at the membrane side and the crank gear to reduce the heat conductivity, with the holes being offset from one another in the longitudinal direction of the connecting rod and being rotated in the peripheral direction. Secondly, a surface enlargement is provided to radiate heat, at least in the area near the crank drive.

The combination of these measures, which are simple to implement, results in an effective reduction of the temperature of the connecting rod bearing, the consequence of which is a corresponding increase in its lifespan. The through holes, which are offset from one another in the longitudinal direction and rotated in the peripheral direction, reduce the cross section of the connecting rod that conducts the heat, but only reduce the strength minimally due to the holes being shifted longitudinally. Heat still finding its way to the end of the connecting rod near the crank drive can then be dissipated to the surroundings effectively by means of the surface enlargement provided there.

To this end, cooling ribs are provided as the surface enlargement, with the ribs being located in the connecting rod end near the crank drive that holds the connecting rod shaft, in particular at the conical transition section. The cooling accomplished by the cooling ribs is especially effective as a result of the crank or eccentric motion, resulting in practically no increased temperature load on the connecting rod bearing and its surroundings despite high temperatures in the area of the connecting rod end.

It is preferable for adjacent through holes to be rotated peripherally by 90° with respect to one another, and they are preferred to have a center-to-center distance of less than the diameter. By offsetting these holes from one another in the longitudinal direction of the connecting rod, the holes engage one another and thus result in especially good ventilation and cooling in this area as well, but for the most part the strength of the connecting rod is maintained.

If necessary, one or more through holes can be provided at the end of the connecting rod near the crank drive, preferably in the area between the cooling ribs and the connecting rod bearing, to reduce the thermal conductivity and/or to dissipate the heat to the adjacent cooling ribs in particular. On the one hand, this reduces the heat-conducting cross sectional area and on the other hand attains air circulation through the holes, and thus heat removal. Also, this facilitates the targeted delivery of heat toward the cooling ribs.

It is advantageous if the connecting rod is made of steel, in particular stainless steel. Stainless steel has the advantage in comparison to aluminum, which is otherwise mainly used, of providing a lower thermal conductivity for the connecting rod while at the same time having good strength characteristics.

BRIEF DESCRIPTION OF THE DRAWINGS

Below, the invention and its essential details are described in more detail.

In the drawings:

FIG. 1 is a longitudinal cross-sectional view through a gas measuring pump,

FIG. 2 is a partial section of a connecting rod, and

FIG. 3 is a cross sectional representation of a connecting rod at the area of a through hole.

DETAILED DESCRIPTION OF THE PREFERRED EMBODIMENTS

A gas measuring pump 1 shown in FIG. 1 has a pump housing 2 with a pump chamber 3 located in it. The chamber is sealed on one side by a pump head cover 4 and on the other side by a working membrane 5 and a connecting rod end 6. The working membrane 5 is held along its outer edge between the pump head cover 4 and a circular housing section 7 and centrally at the connecting rod end 6, and is connected to a crank drive 9 by means of a connecting rod 8 that is connected to the connecting rod end 6.

The gas measuring pump is a heated pump with a heating device inside the pump head 10. This allows the pump head to be heated to many 100's of ° C. as necessary.

To provide thermal insulation, an insulating housing 13 is provided whose inside wall 15 is set apart from the pump head 10 to form a gas insulation layer 14.

In the preferred embodiment, the inside wall of the insulating housing 13 is also provided with a heat-resistant thermal insulation layer 16, preferably made of glass fiber material, the inside of which forms the inner wall 15 that is set apart from the pump head.

This inner wall 15 of the insulating housing is provided with a reflecting layer that reflects the thermal radiation to improve the overall insulation even more.

The reflecting layer is formed, in particular, by means of a mirror-finished reflection layer, preferably made of stainless steel. If no layer 16 is provided, the reflection layer can also be applied directly onto the inside of the insulating housing 13.

It is also possible for the insulating housing 13 to be designed in a sandwich fashion with a metal hood on the inside that is spaced at a distance from the pump head 6, with the hood preferably being made of stainless steel, followed outward by a heat-resistant thermal insulation layer 16 and a thermally insulating plastic layer as the external layer that forms the outer hood of the insulating housing 13.

As is easily recognizable in FIG. 1, the insulating housing encloses at least the pump head all around, with penetrations being provided at least for pressure and suction feed lines as well as for the connecting rod 8.

In order to prevent the transfer of heat from the pump head 10 to the crank drive 9 through the connecting rod 8 from occurring at a level that can damage the connecting rod bearing, measures are taken in the area of the drive transfer to reduce the heat transfer to the crank drive 9.

To reduce the thermal conductivity, through holes 11, 11*a* are provided that are offset from one another in the longitudinal direction of the connecting rod and rotated in the peripheral direction. As are clearly shown in FIG. 2 in an enlarged representation, adjacent through holes 11, 11*a* are rotated with respect to one another by 90°, and they have a center-to-center distance of less than their hole diameter. The hole channels are thus connected. On the one hand, this reduces the thermal conductivity of the connecting rod 8. Moreover, the through holes 11, 11*a* facilitate good ventilation and thus heat dissipation. By offsetting the through holes 11, 11*a* and connecting their channels, good strength is maintained despite the overall reduction in thermal conductivity and thus increased heat radiation.

In the preferred embodiment, two adjacent through holes 11, 11*a* are provided. Depending on the length of the connecting rod, however, more than two through holes 11, 11*a* can be provided also.

To radiate heat, a surface enlargement is provided by cooling ribs 12, at least in the area near the crank gear. In the preferred embodiment, these ribs are located in the conical transition section of the end of the connecting rod near the crank drive. This achieves an effective radiation of heat in this area, which can be aided further by providing one or more other through holes 11*b*, preferably between the cooling ribs 12 and the connecting rod bearing. The through holes 11*b* are located such that heat is transferred to the adjacent cooling ribs, at which point heat is radiated, as is indicated by the arrows in FIG. 1.

The combination of reduced thermal conductivity on the one hand and increased ability to radiate heat on the other results in a significant temperature drop along the heat transfer path between the pump head 10 and the crank gear 9. This results in conventional operating temperatures which are not damaging to the connecting rod bearing, occurring at the connecting rod bearing despite high operating temperatures in the area of the pump head 10.

What is claimed is:

1. A measuring gas pump comprising a pump housing, a pump chamber located in the pump housing that is sealed off by a working membrane, the membrane being driven by a crank drive connected to one of a connecting rod and a displacement mechanism, wherein a heating device is provided in a pump head of the pump housing, and heat insulation is provided that encloses at least the pump head, the heat insulation comprising an insulating housing (13) having an inner wall (15) that is spaced apart from the pump head (8) to form an insulating gas layer (14), and the insulating housing includes a heat radiation reflecting reflection layer (17), wherein the insulating housing (13) is a sandwich construction, having a metal hood on an inside thereof spaced apart from the pump head (6), the metal hood being made of stainless steel, followed outward by a heat-resistant thermal insulation layer (16), and then by an external thermal insulation layer made of plastic.

2. A measuring gas pump according to claim 1, wherein the thermal insulation layer (16) is made of glass fiber material or similar heat-resistant material.

3. A measuring gas pump according to claim 1, wherein the heat radiation reflecting reflection layer is a mirror-finished stainless steel.

4. A measuring gas pump according to claim 1, wherein the insulating housing (13) encloses at least the pump head (10) on all sides, and penetrations are provided, at least for pressure and suction lines, as well as for the connecting rod (8).

5. A measuring gas pump according to claim 1, wherein to reduce heat transfer to the crank drive in an area of drive transmission between the connecting rod end (6) at the membrane side and the crank drive (9), through holes **(11, 11*a*) are provided to reduce the thermal conductivity, the holes being offset from one another in a longitudinal direction of the connecting rod and rotated about a longitudinal axis of the connecting rod, and a surface enlargement (12)** is provided for heat radiation at least in an area adjacent to the crank drive.

6. A measuring gas pump according to claim 5, wherein adjacent ones of the through holes **(11, 11*a*)** are rotated 90° about the longitudinal axis of the connecting rod with respect to one another and have a center-to-center distance of less than a diameter thereof.

7. A measuring gas pump according to claim 6, wherein cooling ribs (12) are provided as the surface enlargement located at an end of the connecting rod adjacent to the crank drive that holds the connecting rod in a conical transition section.

8. A measuring gas pump according to claim 5, wherein in an area between the cooling ribs (12) and the connecting rod bearing, one or more through holes **(11*b*)** are provided at the end of the connecting rod adjacent to the crank drive to reduce thermal conductivity and/or to dissipate heat to the adjacent cooling ribs.

9. A measuring gas pump according to claim 1, wherein the connecting rod (8) is made of steel or stainless steel.

* * * * *